US005616402A

United States Patent [19]

Roth et al.

[11] Patent Number: 5,616,402

[45] Date of Patent: Apr. 1, 1997

[54] PRINTING RIBBON FOR PRINTING RED SCANNABLE BAR CODES

[75] Inventors: Joseph D. Roth; Richard D. Puckett, both of Miamisburg; Michael W. Olmstead, Centerville, all of Ohio

[73] Assignee: NCR Corporation, Dayton, Ohio

[21] Appl. No.: 653,986

[22] Filed: May 28, 1996

Related U.S. Application Data

[63] Continuation of Ser. No. 35,133, Mar. 19, 1993, abandoned.

[51] Int. Cl.[6] ..... B41M 5/26

[52] U.S. Cl. ..... 428/212; 428/195; 428/484; 428/488.1; 428/690; 428/913; 428/914

[58] Field of Search ..... 428/195, 484, 428/488.1, 690, 913, 914, 207, 212

[56] References Cited

U.S. PATENT DOCUMENTS

| | | | |
|---|---|---|---|
| 2,629,956 | 3/1953 | Switzer | 41/26 |
| 4,029,506 | 6/1977 | Dessauer | 96/48 R |
| 4,627,997 | 12/1986 | Ide | 428/488.1 |
| 4,756,963 | 7/1988 | Yamamoto et al. | 428/334 |
| 4,816,378 | 3/1989 | Powers et al. | 430/301 |
| 4,950,638 | 9/1990 | Yuyama et al. | 503/226 |
| 5,089,350 | 2/1992 | Talvalkar et al. | 428/484 |
| 5,348,348 | 9/1994 | Hanada et al. | 283/91 |

*Primary Examiner*—Pamela R. Schwartz
*Attorney, Agent, or Firm*—Craig E. Miller

[57] ABSTRACT

A printing ribbon for printing bar codes which appear visibly red and are scannable by conventional bar code scanning systems utilizing lasers emitting light having wavelengths in the visible red region and collectors which collect the light reflected from the bar codes. This is accomplished by the provision of a printing ribbon having a printing medium adhered to a backing element. The printing medium preferably includes an interspersed distribution of pigments which are retained in a binder. These pigments can include a combination of red coloring agents, such as visible red pigments which visibly appear red under broad spectrum light, fluorescent pigments which are inactive under light having wavelengths in the visible red region, but which fluoresce under broad spectrum light, and red absorbing agents, such as visible black or other dark colored pigments. The fluorescent pigments are activated under broad spectrum light and act to shield or mask the dark color of the visible black or other dark colored pigments, thus making the printed image appear red in broad spectrum light. This results in printed bar codes which appear visually red under broad spectrum light, yet are scannable by bar code scanning systems utilizing lasers emitting light having wavelengths in the visible red region and collectors which collect the light reflected from the bar codes.

17 Claims, 1 Drawing Sheet

PRINTING RIBBON FOR PRINTING RED SCANNABLE BAR CODES

This is a continuation of copending application Ser. No. 08/035,133 filed Mar. 19, 1993, now abandoned.

BACKGROUND AND SUMMARY OF THE INVENTION

The present invention relates generally to new and novel improvements in the printing of scannable bar codes which appear visibly red. More particularly, the present invention relates to printing ribbons capable of printing bar codes which appear visibly red and which are scannable by conventional bar code scanning systems utilizing lasers emitting light having wavelengths in the visible red region and collectors which collect the light reflected from the bar codes.

The identification of products with bar codes is a common practice in retail stores and other similar applications to assist in such activities as the pricing of merchandise, the checkout of customers, and the control and identification of inventory. One widely used product identification bar code convention is the uniform product code (UPC) which consists of alternating dark and light vertical bands of varying-widths. The uniform product code (UPC) has become widely accepted as the standard bar coding method in the retail product area.

A conventional uniform product code (UPC) consists of a series of dark vertical bands of varying widths separated by a series of light vertical bands also of varying widths. When printed on a substrate such as white paper or a printing medium having a light color, the uniform product code (UPC) typically consists of a series of printed vertical black bands of varying widths separated by sufficient spacing to allow the light vertical bands to be formed by the white or light color of the paper or other printing medium remaining between the printed vertical black bands. In other cases, such as when a uniform product code (UPC) is printed on a substrate having a metallic surface or on other materials having a dark color, both the black vertical bands as well as the white vertical bands are printed.

While the convention has been to use black vertical bands separated by white vertical bands for a uniform product code (UPC), it is sometimes desirable to enhance the visual appeal of the uniform product code (UPC) by utilizing other colors. The use of other colors is generally acceptable as long as the contrast between the dark vertical lines and the light vertical lines is sufficient to allow conventional bar code scanners to read the uniform product code (UPC). However, the bar code scanners in many conventional bar code scanning systems use lasers, such as helium neon lasers, which emit light having wavelengths in the visible red region, and collectors which collect the light reflected from the bar codes. When this is the case, a uniform product code (UPC) utilizing the color red for the dark vertical bands would reflect a significant portion of the light emitted from a laser emitting light having wavelengths in the visible red region. Consequently, the red vertical bands appear "light" to the collector which collects the light reflected from the bar code. Thus, in the past, it has been thought that the color red could not be used for the dark vertical bands of bar codes because the bar codes could not be read by conventional bar code scanning systems utilizing lasers emitting light having wavelengths in the visible red region and collectors which collect the light reflected from the bar codes.

Accordingly, an object of the present invention is the provision of a printing ribbon for printing bar codes which appear visibly red and which are scannable by conventional bar code scanning systems utilizing lasers emitting light having wavelengths in the visible red region and collectors which collect the light reflected from the bar codes.

Another object of the present invention is to provide a printing ribbon for printing uniform product codes (UPC) on products which appear visibly red and which are scannable by conventional bar code scanning systems utilizing lasers emitting light having wavelengths in the visible red region and collectors which collect the light reflected from the bar codes.

These and other objects of the present invention are attained by the provision of a printing ribbon for printing bar codes which appear visibly red and which are scannable by conventional bar code scanning systems utilizing lasers emitting light having wavelengths in the visible red region and collectors which collect the light reflected from the bar codes. This is accomplished by the provision of a printing ribbon having a printing medium adhered to a backing element. The printing medium preferably includes an interspersed distribution of pigments in a binding substrate. These pigments can include a combination of red coloring agents, such as visible red pigments which appear visibly red under broad spectrum light, fluorescent pigments which are inactive under light having wavelengths in the visible red region, but which are activated by broad spectrum light, and red absorbing agents, such as visible black or other colored pigments. The fluorescent pigments are activated under broad spectrum light and partially mask or shield the dark color of the visible black or other colored pigments, thus making the printed image appear red in broad spectrum light. This results in printed bar codes which visually appear red under broad spectrum light, yet are scannable by bar code scanning systems utilizing lasers emitting light having wavelengths in the visible red region and collectors which collect the light reflected from the bar codes.

Other objects, advantages and novel features of the present invention will become apparent in the following detailed description of the invention when considered in conjunction with the accompanying drawings.

DETAILED DESCRIPTION OF THE DRAWINGS

Figure 1:
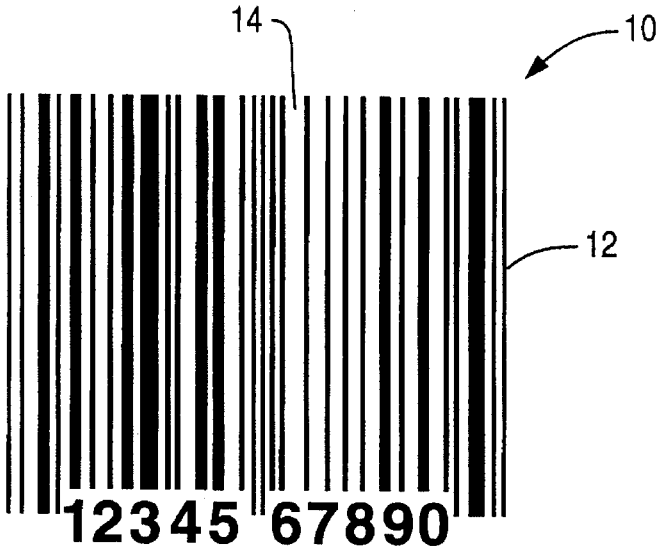
FIG. 1 illustrates a conventional uniform product code (UPC).

Referring now to the drawings, in which like-referenced characters indicate corresponding elements throughout the several views, attention is first drawn to FIG. 1 which illustrates a conventional uniform product code (UPC), generally identified by reference numeral 10. Uniform product code (UPC) 10 consists of a series of dark vertical bands 12 having varying widths separated by a series of light vertical bands 14 also having varying widths. When uniform product code (UPC) 10 is printed on a substrate such as white paper or some other light printing media, dark vertical bands 12 are conventionally printed utilizing a black ink and light vertical bands 14 are generally formed by the white paper or the other light printing media appearing between printed dark vertical bands 12. It will be recognized by those skilled in the art that both dark vertical bands 12 and light vertical bands 14 could be printed, as is often the case when uniform product code (UPC) 10 is printed on substrates having a metallic surface or materials having a dark color.

While the color black has generally been used for dark vertical bands 12 and the color white has generally been used for light vertical bands 14, other color combinations can be used as long as the contrast between the colors is sufficiently discernible to conventional bar code scanning systems. In practice, it is sometimes desirable to use other color combinations to enhance the visual appeal of uniform product code (UPC) 10, as well as the visual appearance of the product packaging.

However, one color which has not, to the inventors' knowledge, been successfully used is the color red for dark vertical bands 12. Uniform product code (UPC) 10 is generally read by a bar code scanning system. Such bar code scanning systems commonly utilize helium neon lasers which emit light having wavelengths in the visible red region. Collectors then measure the amount of emitted light reflected by uniform product code (UPC) 10. In general, dark vertical bands 12 absorb a greater portion of the emitted light than light vertical bands 14. This difference provides the necessary contrast between dark vertical bands 12 and light vertical bands 14 to allow uniform product code (UPC) 10 to be read by conventional bar code scanning systems.

However, the use of the color red in dark vertical bands 12 will generally reflect, rather than absorb, light having wavelengths in the visible red region, such as the light emitted from lasers operating in the visible red wavelength region. Thus, the color red, while appearing visibly "dark" under broad spectrum light, has traditionally provided insufficient contrast with a white background to provide a scannable uniform product code (UPC) 10 for conventional bar code scanning systems utilizing lasers emitting light having wavelengths in the visible red region.

Figure 2:
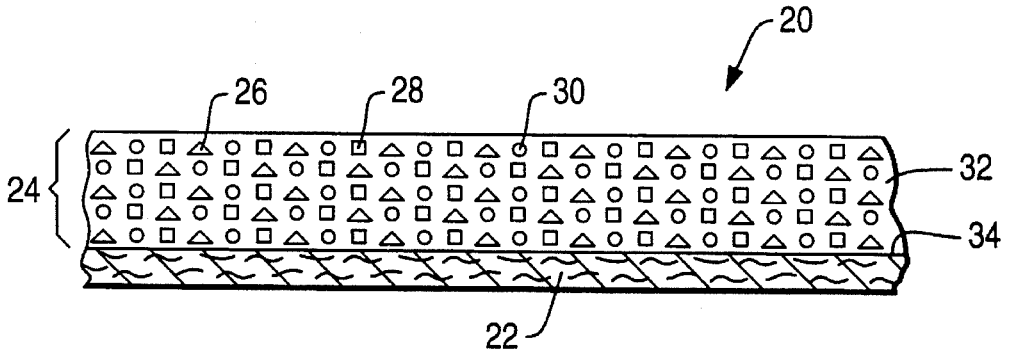
FIG. 2 is a cross-sectional side view of a preferred embodiment of a single-layer printing ribbon for printing red scannable bar codes in accordance with the present invention.

Thus, in accordance with a first preferred embodiment of the present invention, a single-layer printing ribbon, generally identified by reference numeral 20, is shown in FIG. 2. Printing ribbon 20 generally consists of printing medium 24 which is adhered to top surface 34 of backing element 22. Backing element 22 is preferably a long narrow strip of a flexible polymeric material, such as Mylar, available from E. I. Dupont de Nemours & Co., Inc. in Wilmington, Del. Backing element 22 should be compatible with printing medium 24, and preferably has sufficient tensile strength to resist tearing, while being sufficiently flexible to be wound around a spool or reel.

Printing medium 24 preferably includes an interspersed distribution of red coloring agents and red absorbing agents in binding substrate 32. In the preferred embodiment shown in FIG. 2, the red coloring agents include visible red pigments 26 and fluorescent pigments 30. The red absorbing agents include visible black or other dark colored pigments 28. Visible black or other dark colored pigments 28 most preferably include carbon black pigments, but could also include visible green, brown, blue and other dark colored pigments. Visible red pigments 26 allow uniform product code (UPC) 10 to visually appear red under broad spectrum light. On the other hand, visible black or other dark colored pigments 28 allow uniform product code (UPC) 10 to appear "dark" under light having wavelengths in the visible red region. Fluorescent pigments 30 are inactive under light having wavelengths in the visible red region and thus the "dark" appearance of uniform product code (UPC) 10 is not changed under exposure to light having wavelengths in the visible red region. However, when fluorescent pigments 30 are exposed to broad spectrum light, they fluoresce or become "active".

Thus, when exposed to broad spectrum light, fluorescent pigments 30 in printed dark vertical bands 12 of uniform product code (UPC) 10 fluoresce and act to "mask" or "shield" the dark color resulting from visible black or other dark colored pigments 28. Therefore, when uniform product code (UPC) 10 is exposed to light emitted from a laser operating in the visible red wavelength region, visible black or other dark colored pigments 28 absorb a greater proportion of the emitted light. This causes the collector which collects the light reflected from uniform bar code (UPC) 10 to read dark vertical bands 12 as "dark". On the other hand, when uniform product code (UPC) 10 is exposed to broad spectrum light, fluorescent pigments 30 fluoresce and act to visually "mask" or "shield" the color black resulting from visible black or other dark colored pigments 28. This permits uniform product code (UPC) 10 to appear visually red under broad spectrum light. Binding substrate 32 retains the interspersed distribution of visible red pigments 26, visible black or other dark colored pigments 28 and fluorescent pigments 30 against backing element 22 prior to the printing operation. In addition, binding substrate 32 retains the interspersed distribution of visible red pigments 26, visible black or other dark colored pigments 28 and fluorescent pigments 30 once printing medium 24 is transferred onto paper or print receiving media.

Different types of fluorescent pigments 30 can be used in the formulation of the present invention. For example, fluorescent red pigments which fluoresce to the color red when exposed to broad spectrum light can be used. In addition, or in the alternative, fluorescent brightener pigments which fluoresce to the color blue when exposed to broad spectrum light can be used. The human eye perceives the color blue as white when fluorescent brightener pigments are activated by broad spectrum light.

A preferred formulation for the preferred embodiment of single-layer printing ribbon 20 shown in FIG. 2 is given below:

| Ingredient | % Dry | % Dry Range | Grams Dry | Grams Wet |
|---|---|---|---|---|
| Mineral Spirits | — | — | — | 400.0 |
| Modified Hydrocarbon Wax | 23.5 | 20–30% | 23.5 | 23.5 |
| Fully Refined Paraffin Wax | 39.2 | 25–45% | 39.2 | 39.2 |
| Carnauba Wax | 10.2 | 5–40% | 10.2 | 10.2 |
| Ethyl Vinyl Acetate Copolymer Resin | 5.6 | 2–10% | 5.6 | 5.6 |
| Visible Red Pigments | 15.0 | 10–25% | 15.0 | 15.0 |
| Carbon Black Pigments | 0.5 | 0.1–4.5% | 0.5 | 0.5 |
| Fluorescent Pigments | 6.0 | 3–15% | 6.0 | 6.0 |
| Total | 100.0 | | 100.0 | 500.0 |

In the above preferred formulation of single-layer printing ribbon 20, the hydrocarbon wax used is marketed as "WB-17 Modified Hydrocarbon Wax" by Petrolite Corporation in Tulsa, Okla.; the fully refined paraffin wax used is marketed as "Paraffin 1014 Fully Refined Paraffin Wax" by Boler Petroleum Company in Wayne, Pennsylvania; the carnauba wax used is marketed as "Carnauba NC #3 Wax" by R. A. Baldini & Co. in Millburn, N.J.; the ethyl vinyl acetate copolymer resin used is marketed as "Elvax 40 W Ethyl Vinyl Acetate Copolymer Resin" by Chemcentral in Atlanta, Ga.; the visible red pigments used are marketed as "Sico Red L 3652 HD Pigment" by BASF Corporation in Holland, Mich.; the carbon black pigments used are marketed as "Conductex SC Pigment" by Columbia Chemicals Company in Atlanta, Ga.; the fluorescent pigments used are marketed as "Calcofluor White LD Brightening Agent" by BASF Corporation in Parsippan, N.J.; and the backing element used is marketed as "4.5 micron Polyester Film" by E. I. Dupont de Nemours & Co., Incorporated in Wilmington, Del.

To fabricate single layer printing ribbon 20, a wax emulsion of mineral spirits, modified hydrocarbon wax, fully refined paraffin wax, carnauba wax and ethyl vinyl acetate copolymer resin is made by mixing these ingredients together and heating the mixture to 190° F. for thirty minutes. Next, the visible red pigments, carbon black pigments and fluorescent pigments are added and the resultant mixture is ground in an attritor for approximately ninety minutes. The resultant mixture is then coated at 140°–150° F. onto the backing element at a dry coat weight of 3.1±0.5 grams per square meter to form finished single-layer printing ribbon 20.

While the above formulation has been found to admirably accomplish the objects of the present invention, other formulations could be utilized. For example, fluorescent pigments 30 could consist of a combination of both red fluorescent pigments as well as fluorescent brightener pigments. As an alternative formulation, visible red pigments 26 could be eliminated and fluorescent pigments 30 consisting of a combination of red fluorescent pigments and fluorescent brightener pigments could be used as the red coloring agents to provide the visually red appearance under broad spectrum light. As another alternative formulation, fluorescent pigments 30 consisting of red fluorescent pigments, along with visible red pigments 26, could be used as the red coloring agents. As a final alternative formulation to be given here, visible red pigments 26 could be eliminated, and fluorescent pigments 30 consisting of red fluorescent pigments could act as the sole red coloring agent. In this last formulation, the fluorescent red pigments provide the visually red appearance of uniform product code (UPC) 10.

Figure 3:
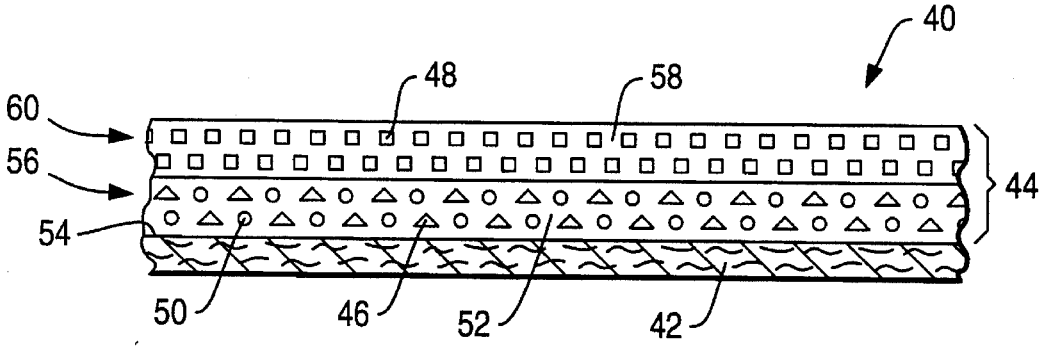
FIG. 3 is a cross-sectional side view of a preferred embodiment of a multi-layered printing ribbon for printing red scannable bar codes in accordance with the present invention.

As seen in FIG. 3, the printing ribbon of the present invention can also be formulated in a multi-layer printing ribbon, generally indicated by the reference numeral 40, for printing scannable red bar codes. Multi-layer printing ribbon 40 generally includes printing medium 44 which is adhered to top surface 54 of backing element 42. In a preferred embodiment of multi-layer printing ribbon 40, visible red pigments 46 and fluorescent pigments 50 are retained in an interspersed distribution in binding substrate 52 in bottom layer 56. Visible black or other dark colored pigments 48 are retained in an interspersed distribution in binding substrate 58 in top layer 60. Binding substrate 52 is compatible with and adheres to top surface 54 of backing element 42. Backing element 42 is preferably a long narrow strip of a flexible polymeric material, such as Mylar, available from E. I. Dupont de Nemours & Co., Incorporated.

As formulations of multi-layer printing ribbon 40, bottom layer 56 could include fluorescent pigments 50 consisting of red fluorescent pigments acting alone as the red coloring agents and top layer 60 could include visible black or other dark colored pigments 48 as the red absorbing agents. Another formulation could include visible red pigments 46 and fluorescent pigments 50 consisting of red fluorescent pigments as red coloring agents in bottom layer 56 and visible black or other dark colored pigments 48 as red absorbing agents in top layer 60. A third formulation could include fluorescent pigments 50 consisting of red fluorescent pigments and fluorescent brightener pigments as red coloring agents in bottom layer 56 and visible black or other dark colored pigments 48 as red absorbing agents in top layer 60. In a fourth formulation variation, the red coloring agents in bottom layer 54 could include visible red pigments 46 and fluorescent pigments 50 consisting of fluorescent brightener pigments and the red absorbing agents in top layer 60 could consist of visible black or other dark colored pigments 48. A fifth formulation could include visible red pigments 46 and fluorescent pigments 50, consisting of red fluorescent pigments and fluorescent brightener pigments, as red coloring agents in bottom layer 56 and visible black or other dark colored pigments 48 as red absorbing agents top layer 60.

Although the present invention has been described above in detail, the same is by way of illustration and example only and is not to be taken as a limitation on the present invention. For example, the teachings of the present invention could be applied to other methods of printing bar codes which appear visibly red and which are scannable by conventional bar code scanning systems utilizing lasers emitting light having wavelengths in the visible red region and collectors which collect the light reflected from the bar codes, such as fabric-type printing ribbons used in conjunction with impact printing methods. Furthermore, the ribbon for printing red scannable bar codes could be utilized for bar code systems other than the uniform product code (UPC) described herein, or for other identification markings readable by lasers emitting light in predetermined wavelength regions. Accordingly, the scope and content of the present invention are to be defined only by the terms of the appended claims.

What is claimed is:

1. A printing ribbon for printing a red scannable bar code image readable by a bar code scanning system using a laser emitting light in the visible red wavelength region, said printing ribbon comprising:

a backing element having a top surface;

a binder adhered to said top surface of said backing element;

said binder having an interspersed distribution of red coloring agents which appear red under broad spectrum light;

red absorbing agents which appear dark under broad spectrum light; and fluorescent pigments which fluoresce and mask the appearance of red absorbing agents so that the ribbon has an overall red appearance in broad spectrum light and which are inactive in light having wavelengths in the visible red region so that said red scannable bar code image is scannable by said bar code scanning system.

2. The printing ribbon in accordance with claim 1, wherein at least a portion of said fluorescent pigments are red fluorescent pigments.

3. The printing ribbon in accordance with claim 1, wherein at least a portion of said fluorescent pigments are fluorescent brightener pigments.

4. The printing ribbon in accordance with claim 1, wherein said fluorescent pigments include both red fluorescent pigments and fluorescent brightener pigments.

5. The printing ribbon in accordance with claim 1, wherein said red coloring agents include visible red pigments.

6. The printing ribbon in accordance with claim 1, wherein said backing element is fabricated from a flexible polymeric material.

7. A printing ribbon for printing a red scannable bar code image readable by a bar code scanning system using a laser emitting light in the visible red wavelength region, said printing ribbon comprising:

a backing element having a top surface; and a coating on said top surface of said backing element, said coating including in a wax emulsion an interspersed distribution of visible red pigments which appear red under broad spectrum light;

black pigments; and fluorescent pigments which fluoresce and mask the appearance of said black pigments so that the ribbon has an overall red appearance in broad spectrum light and which are inactive in light having wavelengths in the visible red region so that said red scannable bar code image is scannable by said bar code scanning system.

8. The printing ribbon in accordance with claim 7, wherein:

said wax emulsion includes 20–30% modified hydrocarbon wax, 25–45% fully refined paraffin wax, 5–40% carnauba wax and 2–10% ethyl vinyl acetate copolymer resin; and said distribution of visible red pigments, black pigments and fluorescent pigments include 10–25% visible red pigments, 0.1–4.5% carbon black pigments and 3–15% fluorescent pigments.

9. The printing ribbon in accordance with claim 7, wherein:

said wax emulsion includes approximately 23.5% modified hydrocarbon wax, approximately 39.2% fully refined paraffin wax, approximately 10.2% carnauba wax and approximately 5.6% ethyl vinyl acetate copolymer resin; and said distribution of visible red pigments, black pigments and fluorescent pigments includes approximately 15.0% visible red pigments, approximately 0.5% carbon black pigments and approximately 6.0% fluorescent pigments.

10. The printing ribbon in accordance with claim 9, wherein said backing element is fabricated from a flexible polymeric material.

11. A printing ribbon for printing a red scannable bar code image readable by a bar code scanning system using a laser emitting light in the visible red wavelength region, said printing ribbon comprising:

a backing element having a top surface;

a bottom coating layer adhered to said top surface of said backing element and a top coating layer adhered to said top surface of said bottom coating layer, said top coating layer having an interspersed distribution of red absorbing agents;

said bottom coating layer having an interspersed distribution of red coloring agents which appear red under broad spectrum light and fluorescent pigments which fluoresce and mask the appearance of said red absorbing agents so that the ribbon has an overall red appearance in broad spectrum light and said red scannable bar code image is scannable by said bar code scanning system.

12. The printing ribbon in accordance with claim 11, wherein at least a portion of said fluorescent pigments are red fluorescent pigments.

13. The printing ribbon in accordance with claim 11, wherein at least a portion of said fluorescent pigments are fluorescent brightener pigments.

14. The printing ribbon in accordance with claim 11, wherein said fluorescent pigments include both red fluorescent pigments and fluorescent brightener pigments.

15. The printing ribbon in accordance with claim 11, wherein said red coloring agents include visible red pigments.

16. The printing ribbon in accordance with claim 11, wherein said red absorbing agents include carbon black pigments.

17. The printing ribbon in accordance with claim 11, wherein said backing element is fabricated from a flexible polymeric material.

* * * * *